US005109987A

United States Patent [19]

Daboub et al.

[11] Patent Number: 5,109,987

[45] Date of Patent: May 5, 1992

[54] MULTI-LEVEL SORT MACHINE

[75] Inventors: Henry A. Daboub, De Soto; Gary E. Bowland; Paul Gray, both of Wylie, all of Tex.

[73] Assignee: National Presort, Inc., Dallas, Tex.

[21] Appl. No.: 445,482

[22] Filed: Dec. 4, 1989

[51] Int. Cl.[5] ..... B07C 3/02

[52] U.S. Cl. ..... 209/657; 209/900; 271/186; 271/225

[58] Field of Search ..... 209/540, 900, 584, 657, 209/545, 583, 539; 271/184, 185, 186, 225, 290, 297

[56] References Cited

U.S. PATENT DOCUMENTS

| | | | |
|---|---|---|---|
| 2,677,473 | 5/1954 | Piggott et al. | 209/900 X |
| 2,937,739 | 5/1960 | Levy | 209/900 X |
| 3,184,061 | 5/1965 | Levy | 209/900 X |
| 3,343,672 | 9/1967 | De Vries et al. | 209/900 |
| 3,596,782 | 8/1971 | Morris . | |
| 3,599,789 | 8/1971 | Kurczak | 209/657 |
| 3,674,143 | 7/1972 | Hunter et la. | 271/305 |
| 3,709,492 | 1/1973 | Baker et al. | 271/290 |
| 3,750,880 | 7/1973 | Petrovsky et al. | 209/583 |
| 3,884,370 | 5/1975 | Bradshaw | 209/900 X |
| 3,889,811 | 6/1975 | Yoshimura | 209/900 X |
| 4,247,008 | 1/1981 | Dobbs | 209/569 |
| 4,275,875 | 6/1981 | Akers | 271/5 |
| 4,337,866 | 7/1982 | Suling et al. | 209/656 |
| 4,641,753 | 2/1987 | Tamada | 209/900 X |
| 4,718,660 | 1/1988 | Daboub | 271/305 |
| 4,778,062 | 10/1988 | Pavie et al. | 209/900 X |
| 4,880,121 | 11/1989 | D'Elia | 209/900 X |

FOREIGN PATENT DOCUMENTS

| | | | |
|---|---|---|---|
| 1289491 | 2/1969 | Fed. Rep. of Germany | 271/185 |
| 1527377 | 10/1978 | United Kingdom | 209/900 |

*Primary Examiner*—Donald T. Hajec
*Attorney, Agent, or Firm*—Drude Faulconer

[57] ABSTRACT

A high-speed, multi-pocket "small footprint" document sort machine having a large number of sort pockets configured to occupy a relatively small floor space. The pockets are arranged in multiple, horizontal tiers which are vertically spaced with respect to each other.

15 Claims, 8 Drawing Sheets

MULTI-LEVEL SORT MACHINE

1. TECHNICAL FIELD

The present invention relates generally to a document sort machine and in one of its preferred aspects relates to a mail sort machine having a plurality of levels or vertical-arranged tiers of horizontally aligned sort pockets whereby a large number of sort pockets are configured in a relatively small floor space.

2. BACKGROUND ART

In recent years, automated equipment has been developed for the handling of large volumes of documents (e.g., letters, postcards, checks, etc.). For example, high-speed, mail sort machines are now available for automatically sorting large volumes of mail by ZIP Code destination. As will be appreciated, such machines greatly reduce the time and manpower otherwise required in the manual sorting of the mail. Such machines are now in use by both the U.S. Postal Service (USPS) and large government and civilian mailers.

A typical, high-speed sort machine is comprised of a feed section which feeds mail pieces one-by-one past a reader which electronically "reads" the ZIP Code or like information on the piece and generates a signal which directs the piece to its designated sort pocket located in a stacker section of the sort machine. An example of such a sort machine is the MS-1200, manufactured and distributed by National Presort, Inc., Dallas, Tex.

For such a machine to carry out efficient sort schemes, it must have a large number of sort pockets available for each pass of the mail through the machine. Heretofore, machine having large number of pockets have stacker sections in which the pockets are aligned in a single, horizontal row. While such an arrangement greatly simplifies the transport between the feeder and the stacker section, it produces a machine which has a large "footprint". That is, a machine of this type requires a large area of floor space for both installation and operation.

Due to the large floor space required, the use of high-speed, multi-pocket sort machines have been restricted primarily to large Post Offices and/or large mail centers where adequate space is available. However, with the ever increasing volumes of mail, the need arises for efficient, high-speed, multi-pocket sort machines which can be used in either large or small Post Offices and/or mail centers where available floor space is limited.

DISCLOSURE OF THE INVENTION

The present invention in a preferred aspect provides a high-speed, multi-pocket "small footprint" document sort machine having a large number of sort pockets configured to occupy a relatively small floor space. This is accomplished by arranging the pockets in horizontal tiers which are stacked and spaced vertically with respect to each other.

A document transport moves a document, e.g., mail piece, from a feeder section vertically to a point beyond the outmost tier (e.g., uppermost) in the stacker section and then reverses the direction of the mail piece so it will move vertically past the vertically-aligned tiers until a diverter gate diverts the mail piece into a designated tier. The mail piece then moves along its respective tier until it is diverted into a designated pocket.

More specifically, the present sort machine is comprised of a feed section, a document transport section, and one or more stacker sections. The feeder section is comprised of a magazine which is adapted to receive a stack of documents, e.g., mail, which is to be sorted. The magazine feeds the stack of mail onto a means, e.g., a singulator, for feeding individual mail pieces into the document transport section which is comprised of first, second, third, and fourth conveyor means.

The first conveyor means receives a mail piece, e.g., letter, from the feeder section in an upright position and converts its movement from a horizontal direction to a vertical direction and delivers it to a second conveyor means. The second conveyor means carries the letter in the vertical direction until the letter passes the outmost (e.g., uppermost) tier of sort pockets in the stacker section and then reverses direction so that the letter now travels in an opposite substantially vertical direction as it moves into the third conveyor means.

The third conveyor means moves the letter vertically past the tiers of sort pockets in the stacker section and includes a means, e.g., diverter gates, for diverting the letter from the third conveyor means into a fourth conveyor means which is associated with the respective tiers of sort pockets in the stacker section. The fourth conveyor means moves the letter in an upright position into the transport tract of a particular tier in the stacker.

Each stacker section is comprised of a plurality of vertically-spaced, horizontally tiers. Each tier is comprised of a transport tract which extends horizontally along the length of each tier and means (e.g., overlapping belts) for maintaining the letter in constant pinch to move the letter along the tract. A plurality of sort pockets are spaced and aligned horizontally so that the entry into each pocket lies adjacent the tract.

Each pocket is comprised of a deck which is positioned adjacent the tract and extends outward therefrom. A diverter is positioned adjacent each pocket and when inactive, allows the letter to continue along the transport tract and by the pocket. When the diverter is actuated, it intersects the tract and diverts the letter in an upright position onto the deck of the pocket to be stacked with other letters in that pocket. A means, e.g., rotary solenoid, is provided for actuating the diverter. Preferably, the deck of each pocket is inclined at an angle with the horizontal, e.g., 25°, so that gravity will aid in moving the letters into the pocket.

Each pocket also includes a means, e.g., kicker, for moving a letter away from the entry of the pocket after it has been diverted therein. The kicker is positioned to allow entry of the document when in a first position and then extends into the pocket when moved to a second position.

BRIEF DESCRIPTION OF THE DRAWINGS

The actual construction, operation, and the apparent advantages of the present invention will be better understood by referring to the drawings in which like numerals identify like parts and in which.

BEST MODE FOR CARRYING OUT THE INVENTION

Figure 1:
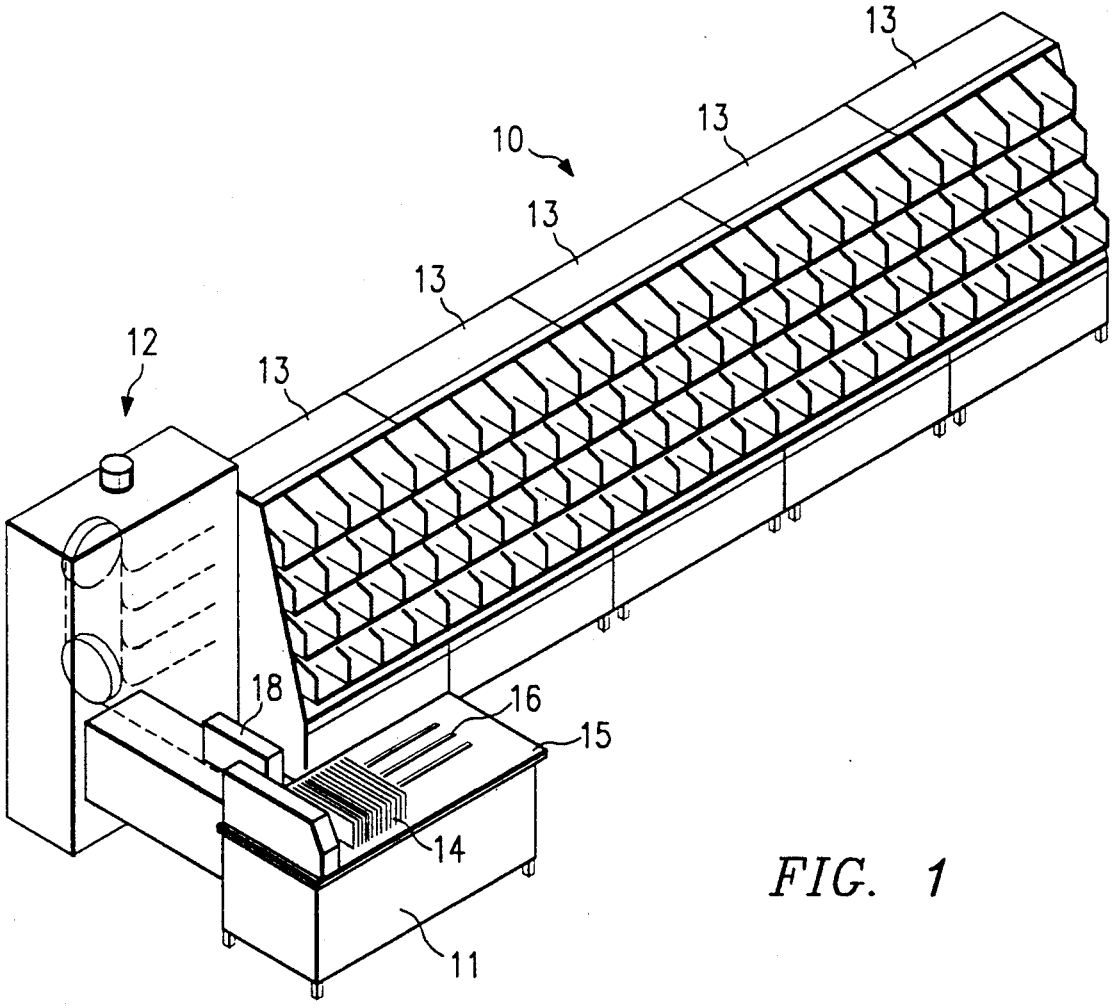
FIG. 1 is a perspective view of the mail sort machine of the present invention.
Figure 3:
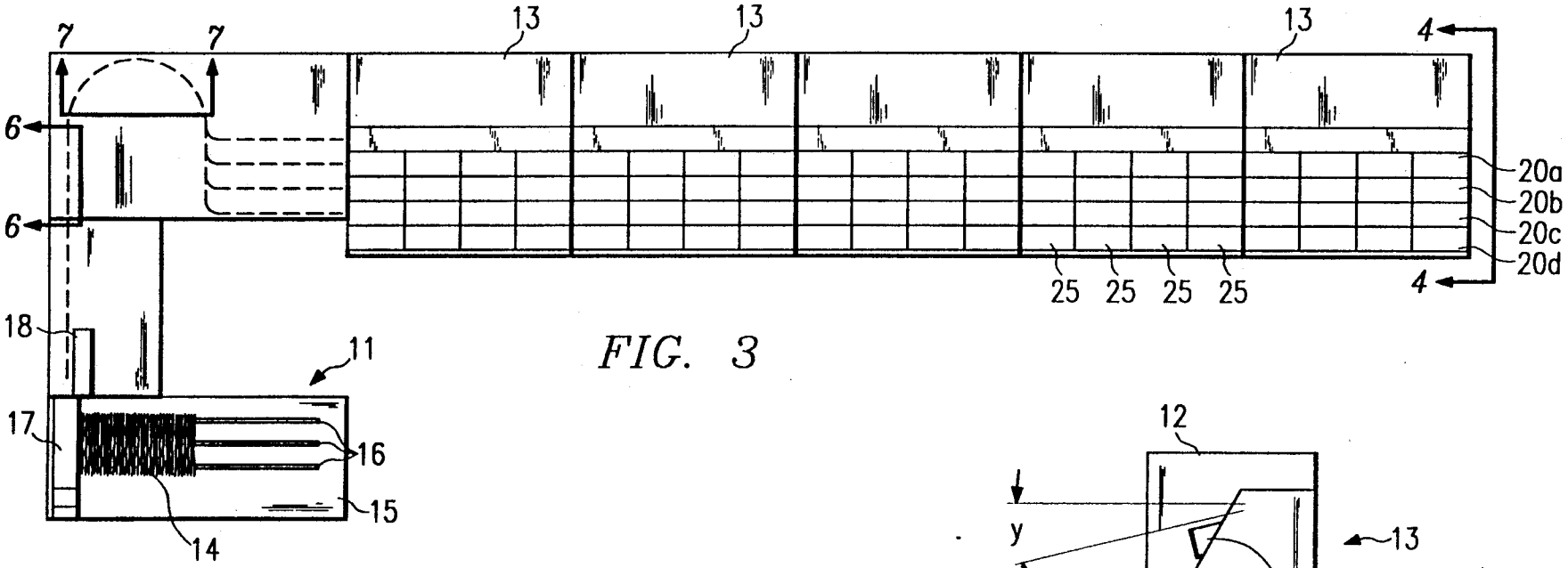
FIG. 3 is a top view of the machine of FIG. 1.

Referring more particularly to the drawings, FIG. 1 discloses a high-speed, document sort machine 10, e.g., machine used to sort mail pieces by their respective ZIP Codes. As illustrated, sort machine 10 is comprised of a feeder section 11, transport section 12, and one or more stacker sections 13 (five shown). Feeder section 11 is comprised of a magazine 15 which receives a batch of mail pieces (letters 14) which are to be sorted. A conveyor means, e.g., motor-driven chains 16 (FIG. 3) feed the letters forward against pickoff or singulator 17 which picks off one letter at a time and moves them into document transport section 12.

Feeder section 11, as described up to this point is old and well known in the art and pickoff 17 may be comprised of any of many known singulators now used for this purpose. For example, pickoff 17 may be a vacuum-operated means which pulls the foremost letter against a moving belt which, in turn, carries the letter into "pinch" between driven rollers to move the letter into the transport section 12; e.g., this type singulator is used in the feed section of the MS-1200, manufactured and distributed by National Presort, Inc., Dallas, Tex. Further, mechanical singulators can be used as pick-off 17, e.g., see co-pending U.S. patent application Ser. No. 07/198,871, filed May 26, 1988.

Each letter 14 is moved along transport 12, passed reader 18 (e.g., Bar Code reader, optical character reader, or the like) which electronically reads indicia (e.g., ZIP Code) on the letter and generates a signal representative of this indicia. This signal is then processed through appropriate hardware and/or software to output a designation signal which directs the letter to its appropriate stacker section 13, as will be further discussed below.

Figure 4:
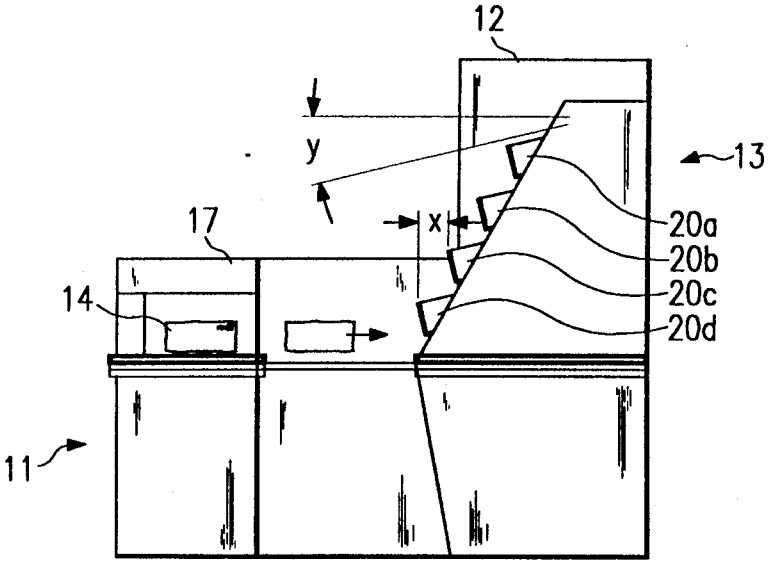
FIG. 4 is an end view of the machine taken along line 4—4 of FIG. 3.
Figure 5:
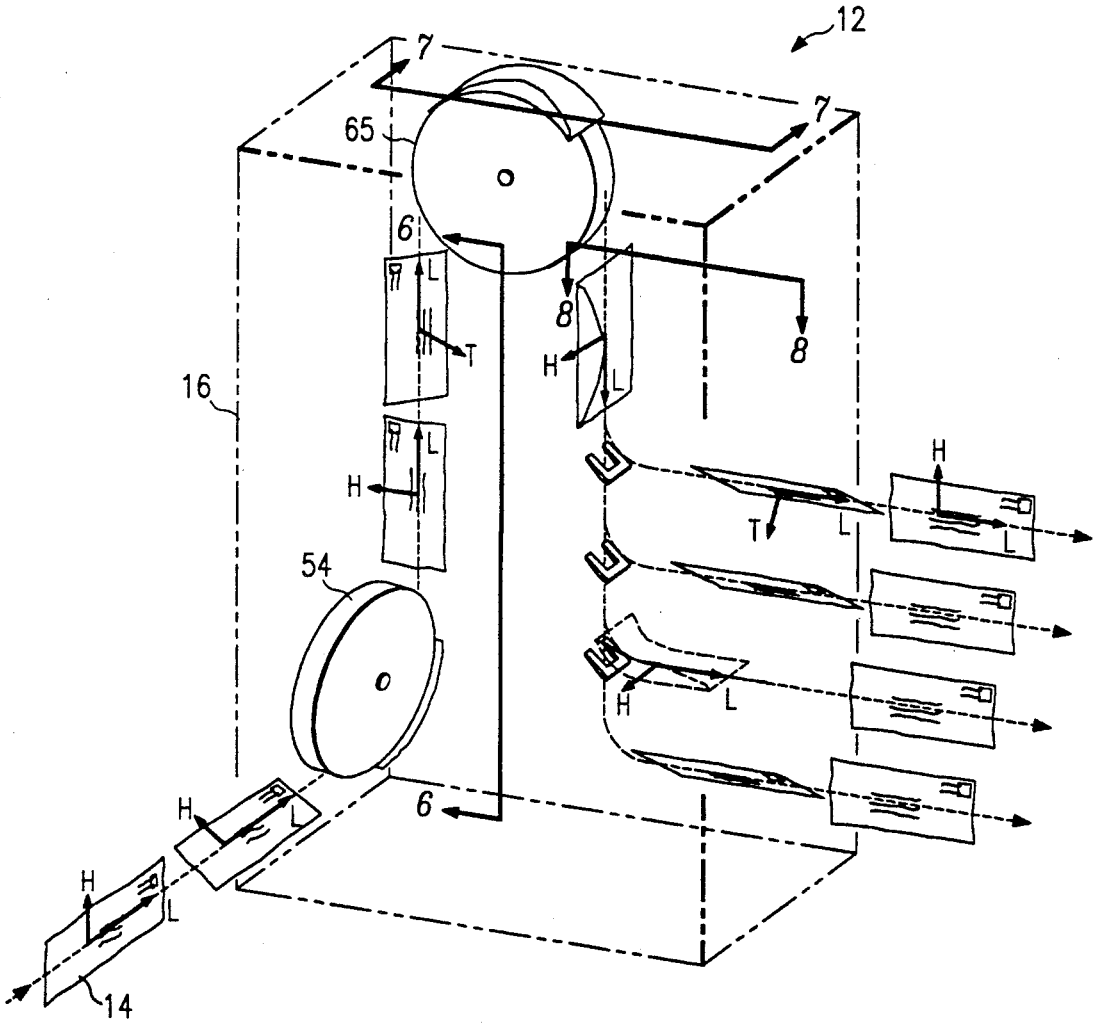
FIG. 5 is a highly simplified perspective illustration of the document transport of the present invention.
Figure 6:
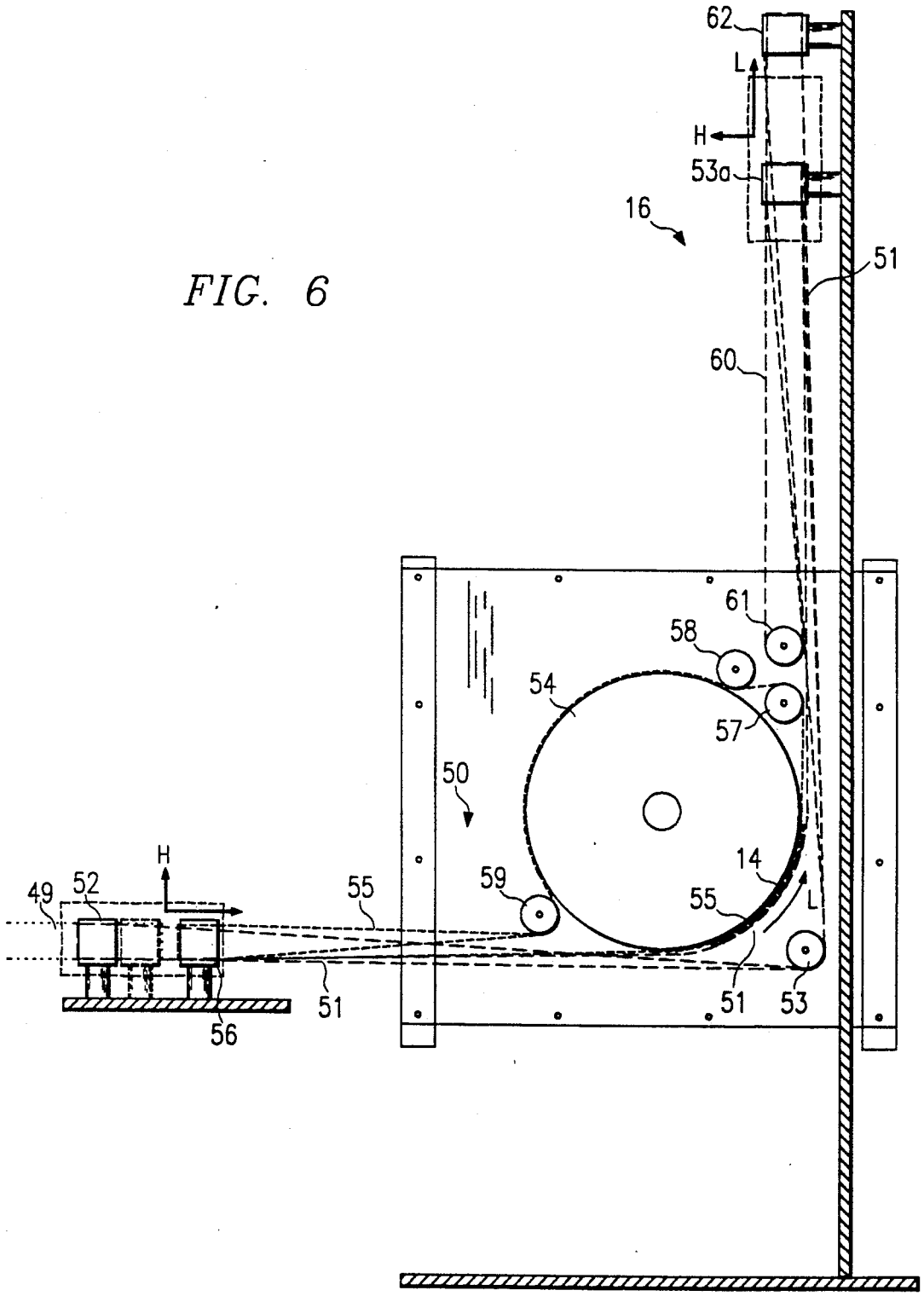
FIG. 6 is an elevational view of a first portion of the document transport of the machine taken along line 6—6 of FIGS. 3, 5, and 7.
Figure 7:
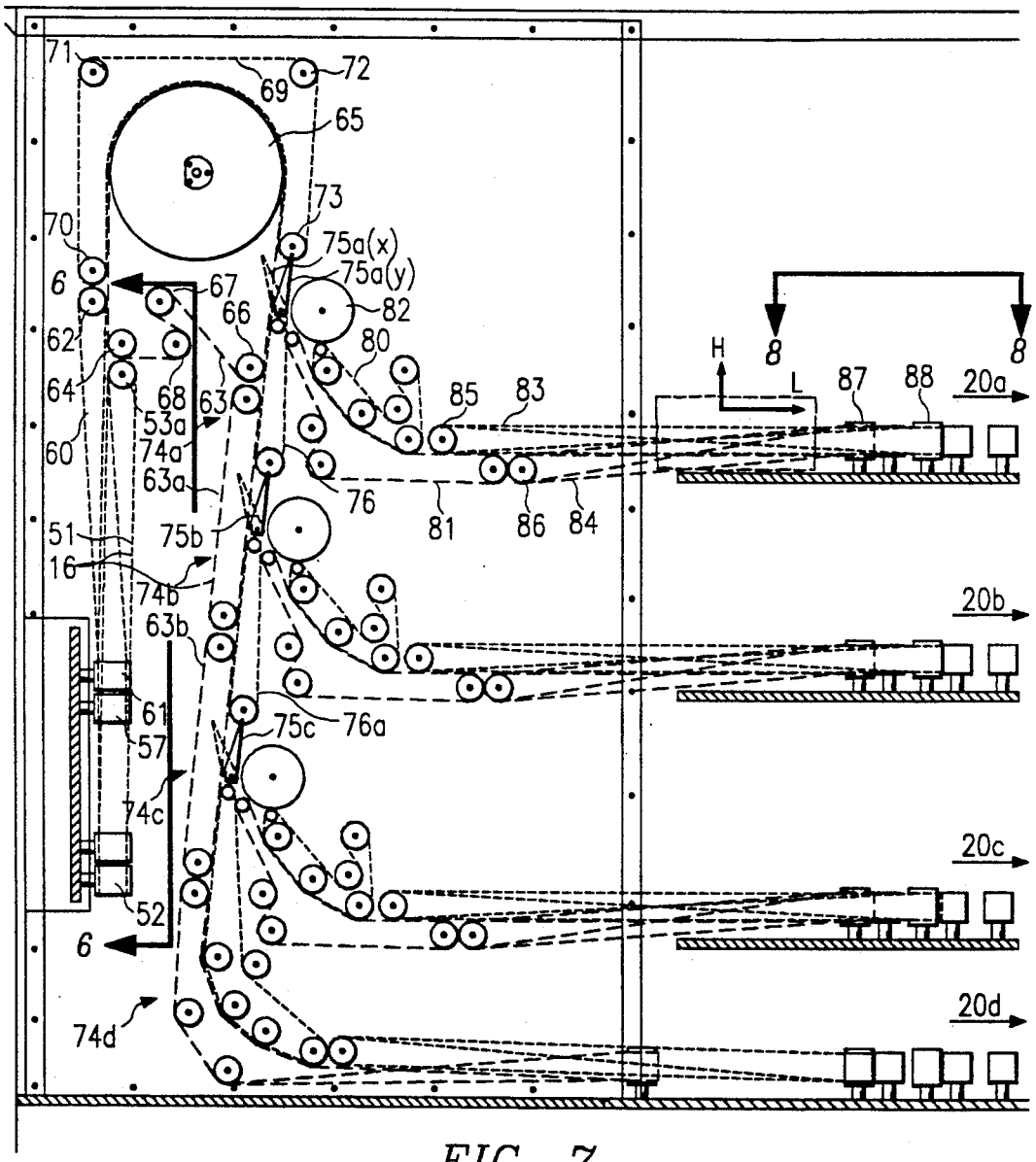
FIG. 7 is an elevational view of a second portion of the document transport taken along line 7—7 of FIG. 5.

Each stacker section 13 is of identical construction and are interchangeable so only one will be described in detail. While five sections 13 are shown as making up mail sort machine 10, it will be understood that any number of stacker sections from one up can be connected together depending on the space available and the total number of sort pockets desired. Each section 13 is comprised of a housing having a plurality of horizontal rows or tiers 20*a–d* (four shown) of stacker pockets 25. Each tier 20 is substantially identical to the others and the actual number may vary as desired. The horizontal tiers are stacked in a vertically-spaced arrangement, one over the other, and preferably progressively offset horizontally from each other as indicated by "x" in FIG. 4. This offset provides easier access to the pockets in each tier when removing the mail from each pocket.

Each tier 20 in each stacker section 13 is comprised of one or more identical sort pockets 25 (four shown in FIGS. 3–4) the entries of which are aligned linearly in the same horizontal plane. As illustrated, all of the sort pockets 25 are aligned on the same side of document transport track (arrow 30 in FIG. 9). The document transport in each section 13 is comprised of a plurality of belts 26 which are mounted on and driven by respective sets of pulleys 27, 28, which, in turn, are linearly aligned and spaced within the stacker housing along one side of the document transport tract 30. Belts 26 are linearly overlapped with belts 31 which are mounted on and driven by respective sets of pulleys 32, 33, which, in turn, are journalled on pocket 25. Belts 26, 31, being overlapped, can yield to accommodate different thicknesses of mail pieces 14. The "gap" between overlapped belts (i.e., the distance between adjacent belts 26 or 31) never exceeds the shortest mail piece, e.g., 4 inches, thereby insuring that that any mail piece is always in constant pinch between the driven belts and is driven along the transport tract 30 until the piece is diverted into its designated pocket as will be explained below.

Figure 8:
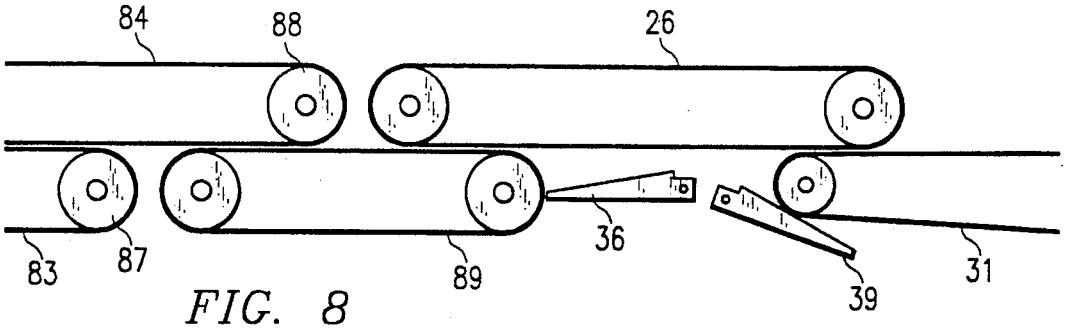
FIG. 8 is a top view of a third portion of the document transport taken along line 8—8 of FIG. 7.
Figure 9:
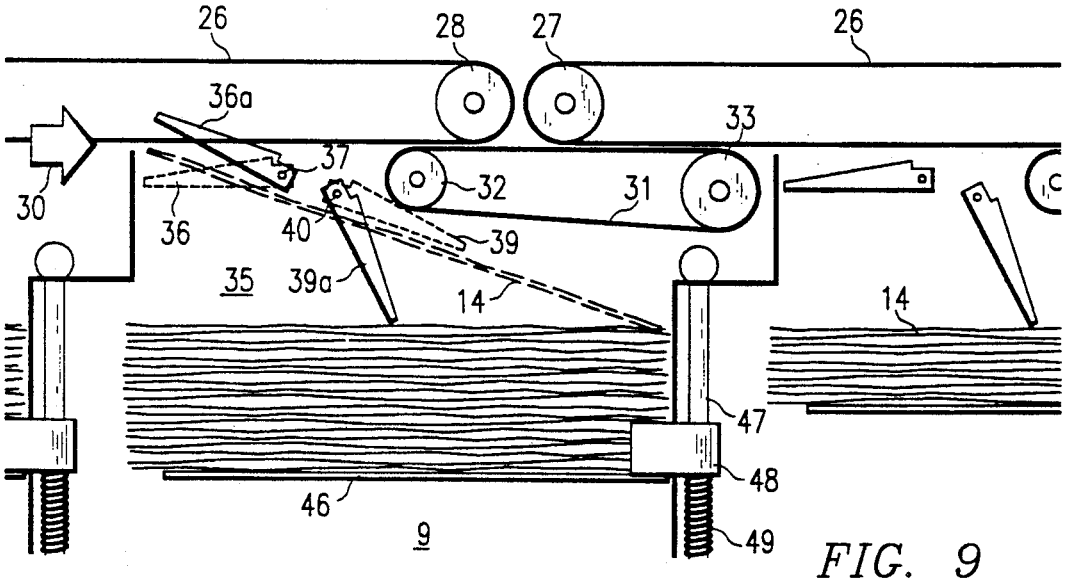
FIG. 9 is an enlarged top view of a sort pocket of the machine of FIG. 1.
Figure 10:
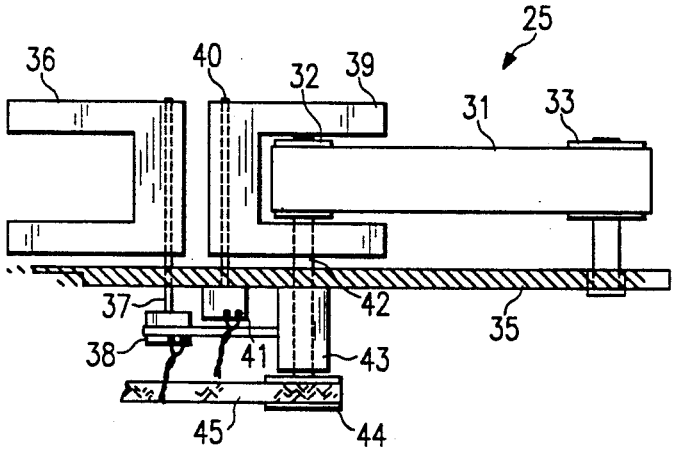
FIG. 10 is a side view of the sort pocket of FIG. 9.
Figure 11:
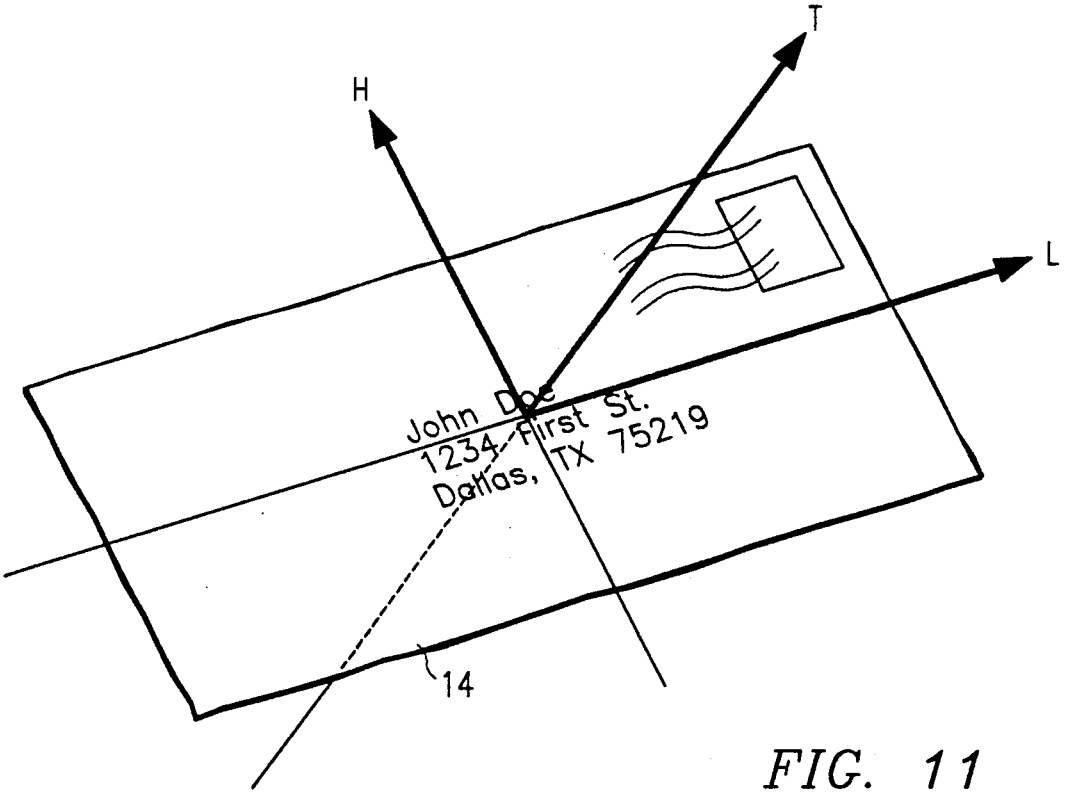
FIG. 11 is an illustration identifying the axes of a mail piece.

Each pocket 25 is comprised of base plate or deck 35 (FIGS. 8 and 9) which is preferably slanted downwardly from the pocket entry at transport line 30 at an angle "y" (FIG. 4) from the horizontal (e.g., 25°). A diverter means, e.g., gate 36, is carried by shaft 37 which, in turn, is journalled through deck 35. Shaft 37 is rotated by solenoid 38 (FIG. 10) through a limited arc to move gate 36 between a first position (e.g., deactuated or normal position 36) and a second position (e.g., actuated position 36*a* (FIG. 9).

Kicker means, (e.g., kicker gate 39 which may have substantially the same configuration as gate 36) is journalled through deck 35 and is rotated by rotary solenoid 41 through a limited arc to move kicker 39 between a first position (e.g., deactuated or normal position 39 and a second position (e.g., actuated position 39*a* (FIG. 8) for a purpose described below.

Both solenoids 38, 41 are of the type which are rotated in one direction against the bias of an internal spring when actuated and are rotated in the opposite direction by the spring force when deactuated, e.g., Model 18 131-001 (Right-hand or Left-hand), Ledex, Inc., Yandalia, Ohio.

Driven pulley 32 of the document transport is carried by shaft 42 (FIG. 9) which is journalled in bearing block 43 on plate 35. Shaft 42 is rotated by pulley 44 and belt 45 which, in turn, is driven from a motor (not shown).

As seen in FIG. 9, gate 36, when in a deactuated or first position 36, lies substantially parallel to transport tract 30 and intersects said tract when in an actuated or second position 36*a*. Kicker gate 39, when in a deactuated or first position 39, is positioned so that it is aligned with gate 36 when gate 36 is in its actuated or first position 36*a*thereby presenting an unobstructed path for letter 14 into entry of pocket 25. A more complete description of the operation of kicker 39 will follow.

Figure 2:
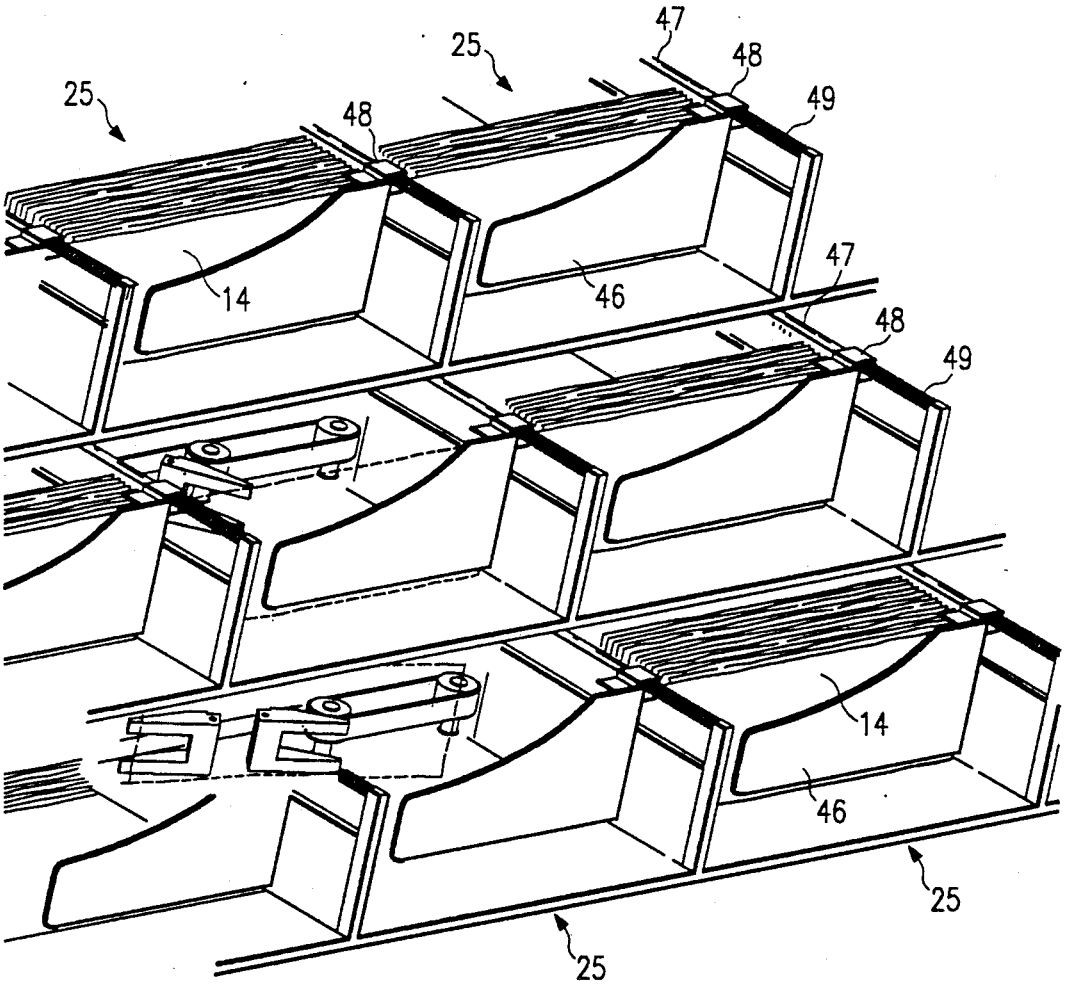
FIG. 2 is an enlarged, perspective view of some of the sort pockets of the machine of FIG. 1.

Mail 14 enters pocket 25 and is stacked against "backing paddle" 46 (FIGS. 2 and 9) which is slidably mounted on rail 47 by a bearing block 48 or the like. Paddle 46 is slightly biased by a spring 49 (FIG. 9) toward the incoming mail. As stated above, deck 35 is inclined downward at an angle "y" (e.g., 25°) whereby the weight (i.e., gravity) of the mail balances the spring bias thereby allowing the paddle and mail to move into pocket 25 gradually as additional mail is diverted thereto.

Referring now to FIGS. 1, 5, 6, and 7, the document transport 16 takes letter 14 and moves them individually and continuously from feeder section 11 to their respective sort pockets 25 in stacker sections 13. For the sake of clarity, the length (L), height (H), and thickness (T) axes (FIG. 10) of a mail piece 14 will be referred to to describe the position of the piece as it moves through the different conveyor sections of transport 16.

A letter 14 is delivered in an upright position from singulator 17 by a first conveyor means, e.g., pinch belts 49, to a second conveyor means, e.g., elevator section 50 of transport 16 (FIG. 6) with the L axis of letter 14 being horizontal and the H axis being vertical. Belt 51 is twisted through 90° between vertical pulley 52 and horizontal, driven pulley 53 and is twisted through another 90° between pulley 53 and horizontal pulley 53*a* which, in turn, is rotated 90° with respect to pulley 53 in the horizontal plane. Continuous belt 51 passes around pulley 53*a*, around fixed, circular guide 54, and back to pulley 52. A second continuous belt 55 passes from vertical pulley 56 through a 90° twist around fixed guide 54, driven pulley 57, tension pulley 58, guide 54, idler pulley 59, and back to pulley 56. It can be seen, that belts 51, 55, are in contact with each other along a portion of their lengths and provide the "pinch" necessary for moving the mail piece 14 from a point adjacent pulley 52, around guide 54, to a point adjacent pulley 57. Also, it can be seen that the twisting of the belts will cause the H axis of the letter 14 to rotate 90° so that the letter will lie flat as its movement changes from a horizontal direction to a vertical direction around guide 54.

Continuous belt 60 passes from pulley 61 and is twisted 90° around driven pulley 62 and is in contact with belt 51 along a portion of their respective lengths to provide the "pinch" necessary to move the letter 14 from a point adjacent pulley 57 to a third conveyor means, i.e., a point adjacent pulley 53*a*. The twists in belts 51, 60 causes the H and T axes of the letter to rotate 90° in the horizontal plane as it is carried between the two belts. Continous belt 63 (FIG. 7) passes around idler pulley 64, fixed-circular guide 65, idler pulleys 66, 67, and driven pulley 68, and lies in contact with belt 60 along a portion of its length to continue the "pinch" for moving letter 14 through the transport.

Continuous belt 69 passes around idler pulleys 70, 71, driven pulleys 72, 73 and around fixed-circular guide 65 where it contacts belt 63 to provide the "pinch" for moving letter 14 around guide 65 to reverse its vertical direction by 180° after the letter has been moved vertically past the outermost 20*a* of the horizontal tiers in stacker section 13.

As the letter moves around guide 65 and begins to move downward in a substantial vertical direction, it enters a third conveyor means which is comprised of a plurality of diverter sections 74 which are aligned in a slightly offset vertical plane whereby letter 14 will pass therethrough until it reaches a point adjacent to its designated tier 20 (i.e., 20*a*, 20*b*, 20*c* or 20*d*). Since each diverter section 74 is substantially identical except for the last one 74*d*, only one will be described in detail.

Section 74 has a diverter which is a gate 75*a–c* which is preferably of the same basic configuration as gate 36 (FIG. 10) and is operated by a rotary solenoid (not shown) similarly as are gates 36, 39, as explained above. When in an inactive position 75*a*(*y*), gate 75 lies substantially parallel with driven belt 63 (63*a*, 63*b* in subsequent sections) to allow the letter to continue on in pinch between the respective driven belts 63, 76 until the designated tier 20 is reached. The designation signal from reader 18 actuates the appropriate rotary solenoid to move its respective gate 75 to its actuated position, e.g., 75*a*(*x*) where gate 75 straddles belt 63 to divert letter into its designated tier. Two driven continuous belts 80, 81 are mounted on their respective pulleys (unnumbered for the sake of clarity) and contact each other along a portion of their length to provide the pinch necessary to complete movement around fixed-circular guide 82 and into pinch between belts 83, 84 of a fourth conveyor means. Belts 83, 84 are both twisted 90° between pulleys 85, 86 and 87, 88, respectively, to rotate the H axis of letter 14 back to vertical as it moves into pinch between belts 89, 26 (FIG. 8) which, in turn, starts the letter in an upright position down the transport tract 30 of its designated tier. Section 74*d* is functionally equivalent to the diverter sections described above except it does not need a diverter gate 75.

Letter 14 will continue down tract 30 of tier 20 until it approaches its designated pocket 25. At this time, gate 36 is actuated to position 36*a* to diverter the letter onto deck 35 of the pocket. Kicker 39 is then moved to position 39*a* (FIG. 9) to "kick" the letter further into the pocket away from the pocket entry where it is stacked in an upright position against paddle 46 and the bias of spring 49. Since deck 35 is inclined at an angle, gravity aids in moving letters 14 and paddle 46 into the pocket as additional letters enter pocket 25.

What is claimed:

1. A stacker section for a document sorting machine, said stacker section comprising:

a) a plurality of vertically-space horizontally-extending tiers, each of said tiers comprising:

1) a transport tract extending horizontally along the length of said tier and adapted to receive a document;

2) means for maintaining said document in constant pinch while in said tract to move said document along said tract in an upright position;

3) a plurality of sort pockets having their entries spaced horizontally along said transport tract; each of said sort pockets comprising:

i. a deck positioned adjacent said tract and extending outward therefrom;

ii. a diverter means positioned adjacent said pocket for allowing said document to continue along said transport tract and by said pocket when in a first position and for intersecting said transport tract when in a second position to thereby divert said document from said transport onto said deck of said pocket where said document is stacked in a substantially upright position; and iii. means for moving said diverter to said first and second positions.

2. The stacker section of claim 1 wherein said plurality of tiers are progressively offset horizontally from each other in a vertical plane.

3. The stacker section of claim 1 wherein said deck is inclined downwardly away from said transport tract at an angle with respect to the horizontal.

4. The stacker section of claim 3 wherein said angle is equal to about 25°.

5. The stacker section of claim 1 wherein said means for maintaining said document in constant pinch along said transport tract includes:

a plurality of first driven, continuous belts spaced and aligned along one side of said transport tract; and a plurality of second driven, continuous belts aligned along the other side of said transport tract and spaced whereby said first belts respectively overlap said second belts thereby providing continuous pinch for said document as it moves along said transport tract.

6. The stacker of claim 1 wherein each sort pocket includes:

means for moving said document away from the entry of said pocket after said document is diverted into said pocket.

7. The stacker of claim 6 wherein said means for moving said document away from the entry of said pocket comprises:

a kicker means positioned to allow entry of document when in a first position and to extend into said pocket when in a second position; and means for moving said kicker to said first and second positions.

8. A sort machine for sorting documents comprising:

a feeder section; a document transport section; and at least one stacker section wherein:

said feeder section comprises:

a magazine adapted to receive a stack of documents to be sorted; and a means for feeding individual documents from said stack of documents into said document transport section; and wherein said document transport section comprises:

means for moving each individual document from said feeder section to said at least one stacker section; and wherein said at least one stacker section comprises:

a) a plurality of vertically-spaced, horizontal tiers, each of said tiers comprising:

1) a transport tract extending horizontally along said tier and adapted to receive a document;

2) means for maintaining said document in constant pinch while in said tract to move said document along said tract while in an upright position with the bottom edge of said document being aligned horizontally with said tract; and 3) a plurality of sort pockets spaced horizontally along said transport tract; each of said sort pockets comprising:

i. a deck positioned adjacent said tract, and extending outward therefrom;

ii. a diverter means positioned adjacent said pocket for allowing said document to continue along said transport tract and by said pocket when in a first or deactuated position and for intersecting said transport tract when in a second or actuated positioned to thereby divert said document from said transport onto said deck of pocket whereby said document is stacked in a substantially upright position with its bottom edge resting on said deck; and iii. means for moving said diverter to said first and second positions.

9. The sort machine of claim 8 wherein said document transport section comprises:

a first conveyor means for receiving an individual document from said feeder section and converting its movement from a horizontal to a vertical direction;

a second conveyor means for reversing the vertical direction of said document after said document has been moved vertically past the outermost of said plurality of horizontal tier of said stacker sections; and a third conveyor means for receiving said document from said second conveyor means and moving said document in a substantial vertical direction;

a plurality of fourth conveyor means, one associated with each of said plurality of said horizontal tiers for receiving said document from said third conveyor means and directing said document into said transport tract of its respective tier in said stacker section; and means for diverting said document from said third conveyor means into its respective tier of said stacker section.

10. The sort machine of claim 9 wherein said plurality of tiers are vertically spaced and are offset horizontally from each other in a vertical plane.

11. The sort machine of claim 10 wherein said deck is inclined downwardly away from said transport tract at an angle with respect to the horizontal.

12. The sort machine of claim 11 wherein said angle is equal to about 25°.

13. The sort machine of claim 12 wherein said transport tract includes:

a plurality of first driven, continuous belts spaced and aligned along one side of said transport tract; and a plurality of second driven, continuous belts aligned along the other side of said transport tract and spaced to overlap said first belts thereby providing continuous pinch for said document as it moves along said transport tract.

14. The sort machine of claim 13 wherein each sort pocket includes:

means for moving said document away from the entry of said pocket after said document is diverted into said pocket.

15. The sort machine of claim 14 wherein said means for moving said document comprises:

a kicker means positioned to allow entry of document when in a first position and to extend into said pocket when in a second position; and means for moving said kicker means to said first and second positions.

* * * * *